United States Patent [19]

Meyers

[11] Patent Number: 4,587,597

[45] Date of Patent: May 6, 1986

[54] EMERGENCY EXIT LIGHT OR THE LIKE

[76] Inventor: Charles J. Meyers, 474 Lake Ave., Woodstock, Ill. 60098

[21] Appl. No.: 673,472

[22] Filed: Nov. 19, 1984

[51] Int. Cl.[4] ..... G09F 13/04

[52] U.S. Cl. ..... 362/20; 362/362; 362/812; 40/553; 40/570

[58] Field of Search ..... 362/20, 367, 362, 812; 40/570, 553

[56] References Cited

U.S. PATENT DOCUMENTS

| | | | |
|---|---|---|---|
| 1,469,946 | 10/1923 | Morrison | 362/812 |
| 2,213,584 | 9/1940 | Hulst | 362/20 |
| 3,136,083 | 6/1964 | Guth, Jr. | 362/812 |
| 3,931,689 | 1/1976 | Shine | 40/570 |
| 4,035,632 | 7/1977 | Rayman | 40/553 |
| 4,201,005 | 5/1980 | Hunt | 362/812 |
| 4,271,621 | 6/1981 | Garcia et al. | 40/570 |
| 4,435,743 | 3/1984 | Plumly | 362/20 |

*Primary Examiner*—Andrew M. Dolinar
*Attorney, Agent, or Firm*—Gary, Juettner & Pyle

[57] ABSTRACT

An emergency light, designed primarily for use in residences, comprises a trapezoidal-shaped box to be mounted above an exit door or other emergency object and having a downwardly and inwardly inclined front face formed of a translucent material bearing the word EXIT or other appropriate directive, and a horizontal bottom wall of transparent or translucent material, the housing containing one or more lights for illuminating the front face to illuminate the directive thereon and to cast light forwardly and downwardly through the front face and downwardly through the bottom wall to illuminate the exit door or other emergency object and the surrounding area to facilitate location of and access to the object; the light or lights preferably being energized at 6, 9 or 12 volts to provide for economy of use and operation.

7 Claims, 4 Drawing Figures

EMERGENCY EXIT LIGHT OR THE LIKE

CROSS REFERENCE

This application is based upon and incorporates the subject matter of invention disclosure document Ser. No. 129,299 filed July 13, 1984.

BACKGROUND OF THE INVENTION

Public and commercial buildings are required by law in most jurisdictions to have illuminated signs posted at all emergency exits and/or contiguous to other emergency objects such as fire extinguishers and the like. The signs serve an efficacious purpose both in the event of an emergency and also as a daily reminder of what to do in the event an emergency occurs. In general, these illuminated signs are heavy duty industrial products energized at line voltage, e.g., 110 volts, and are not within the economic range of expenditures for individual residences and homeowners, either in initial cost or cost of operation.

Residential smoke and fire detectors, same of which are equipped with emergency beacons or lights, are available at economically reasonable cost, but the same are energized only in the event of actual fire, and even if equipped with a beacon or light illuminate only the area in which the detector is installed, not the paths of emergency egress from the residence. Thus, these devices do not serve the efficacious purposes of commercial enterprise emergency lights, either as a daily reminder or in the event of actual emergency. Especially at night, when bedroom doors are closed, a beacon in the hallway will not aid a person behind the closed door. In an emergency, such as awakening in a smoke filled room or with a smoke alarm sounding, many people, especially the very young and very old, can become agitated, confused, disorganized and lost, thus endangering the safety and welfare of themselves and others.

BRIEF SUMMARY OF THE INVENTION

The object of the present invention is to provide a highly effective emergency light serving the efficacious purposes of those used in commercial buildings, but especially designed to fulfill the peculiar and special requirements of occupants of individual residences, particularly in terms of construction, cost and economy of operation.

According to the invention, an emergency light achieving the above stated objectives comprises a generally trapezoidal shaped box to be mounted above the emergency object intended to be illuminated, e.g., an emergency exit, a fire extinguisher, or the like, the box having a downwardly and inwardly inclined front face formed of a light emitting material and intended and adapted to bear an emergency directive, e.g., "EXIT", and a horizontal bottom wall formed of light emitting material; at least one light in said box for illuminating said front face to illuminate the directive thereon and to cast light forwardly and downwardly through the front face and downwardly through the bottom wall to illuminate the emergency object and surrounding area to facilitate location of and access to the object; and means associated with said light for illuminating the same, preferably at low voltage to provide for economy of use and operation.

In the preferred embodiment, the front face of the box is formed of light diffusing translucent material to facilitate reading of the directive thereon and to minimize projection of excessive and distracting light into the room in which the unit is mounted, and the bottom wall is formed of transparent material to direct a beam of relatively bright light directly downward onto the emergency object.

Also in the preferred embodiment, means are provided for convenient operation of the unit from household line voltage, but stepped down to a low voltage to insure economy of operation, and for operation of the unit from a self-contained battery in the event of line voltage power failure thereby to insure continuity of operation in the event of a storm, fire or the like which interrupts electrical service to the residence.

The invention thus provides an emergency light for the home in the form of a small, economical and eye appealing fixture adapted to be installed over an exit door or the like. Due to the low voltage draw, the unit can be operated 24 hours per day, cheaper than an ordinary light bulb. The sloping front of the unit, as well as the bottom wall, direct the light toward the floor, thus eliminating the wasteful projection of light onto the ceiling and making the exit sign more visible to see. Children and older persons in particular can become confused in a smoke filled room, thus causing them to get lost, but with this light unit, the exit sign and the door can readily be seen and a safe exit effected. With a smoke alarm going off in the night, the sign will help to direct an adult or child to safety in the shortest time. Even if crawling on the floor, the sign can be seen because of the slant front design. Thus, the invention provides a low cost economical way to help save lives.

These and other objects and advantages of the invention will become apparent from the following detailed description and accompanying exemplary drawings.

DETAILED DESCRIPTION

Figure 1:
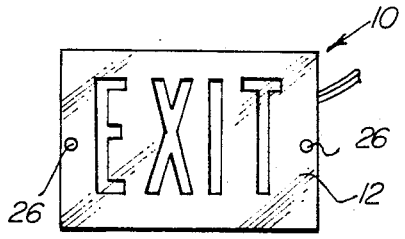
FIG. 1 is a front view of a preferred embodiment of the emergency light of the present invention, showing how the same appears when mounted on a wall above a door.
Figure 2:
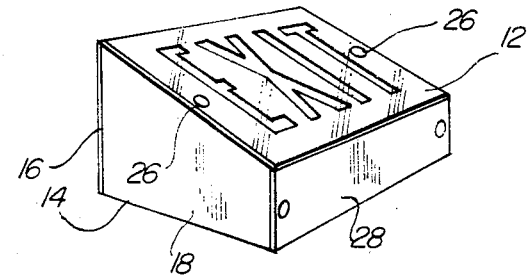
FIG. 2 is a perspective view of the emergency light showing particularly the front face and bottom wall thereof.

Referring to the drawings, the emergency light of the present invention is comprised of a main housing or box 10 of generally trapezoidal shape, thereby to define a downwardly and inwardly facing main surface or front wall 12. The back wall 14, the top wall 16 and the two side walls 18 of the box are preferably formed from one or more pieces of mild steel to provide a rigid, unitary, safe and secure housing for the electrical components of the unit. Alternatively, the back, top and side walls may be formed of any other suitable opaque material, such for example as molded plastic. The back or rear wall 14 of the box serves to mount the electrical components of the unit and is provided with holes 20 for reception of suitable fasteners for anchoring the box to a wall; for example, in the illustrated embodiment, above the jamb of an exit door. The top wall 16 is preferably perforated for purposes of ventilation. The two side walls 18 are of trapezoidal form, with the major depth dimension at the top and the minor depth dimension at the bottom. The front or forward edges of the side walls are provided with in-turned flanges 22, thereby to define mounting surfaces for the front wall or face 12 which are inclined downwardly and inwardly toward the wall or other surface on which the box is mounted. Holes 24 may be provided in the flanges 22 for reception of sheet metal screws 26 or other fasteners for removably securing the front face 12 to the flanges 22. In similar manner, the lower edges of the side walls 18 are provided with in-turned flanges 27 to define downwardly facing horizontal surfaces for reception and mounting of a bottom wall 28 for the box.

Housed within the interior of the box 10 on the back wall 14 thereof is a mounting platform 30 for the components (indicated generally at 32) which support and serve to conduct electricity to a pair of parallel connected light bulbs 34, the platform being formed of ceramic or other appropriate insulating material. The two light bulbs 34 are low voltage bulbs, i.e., 6, 9 or 12 volt bulbs, such as the readily available and economical types of bulbs that are used in flashlights, the rear light of automotive vehicles and the like. The base of the bulbs and the electrical receptacles for the same may be of the screw thread type or the bayonet connector type as desired and/or as readily and economically available in the voltage desired to be used. The bulbs may be energized from any low voltage exterior source, a self-contained step down transformer powered from household line voltage, a self-contained battery and/or any combination thereof.

Figure 3:
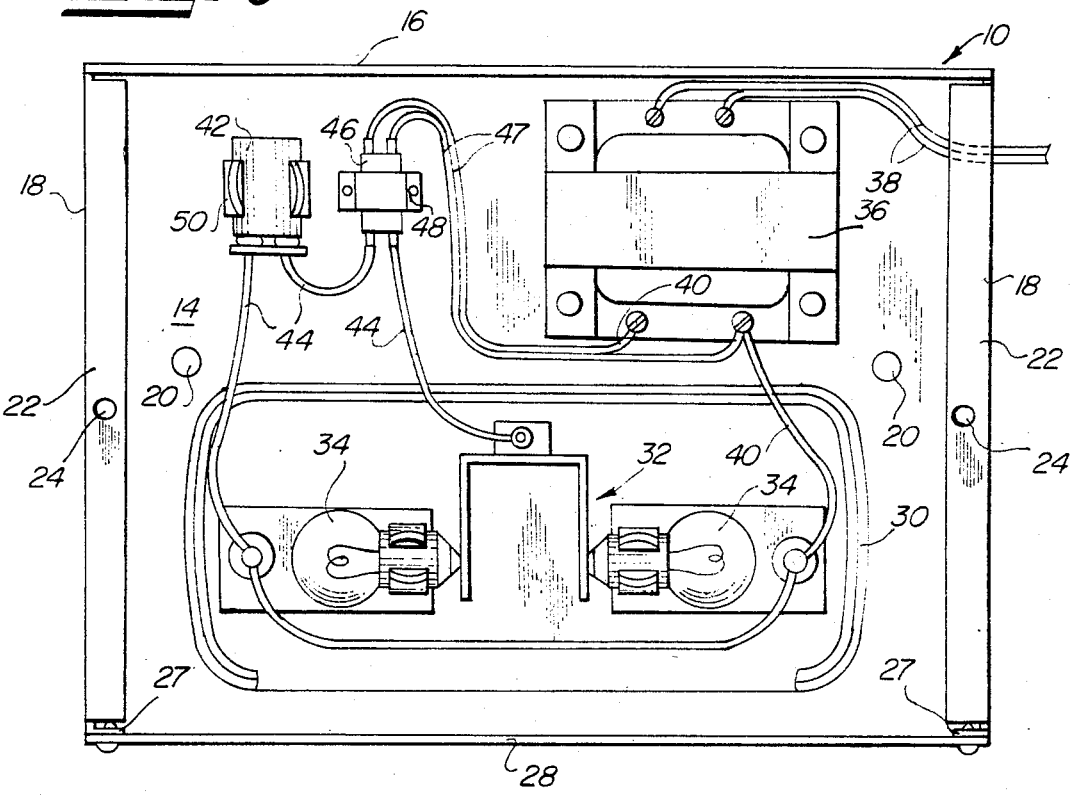
FIG. 3 is a front view of the emergency light taken with the front face of the box removed and showing a preferred embodiment of the components contained within the box for energizing the light.
Figure 4:
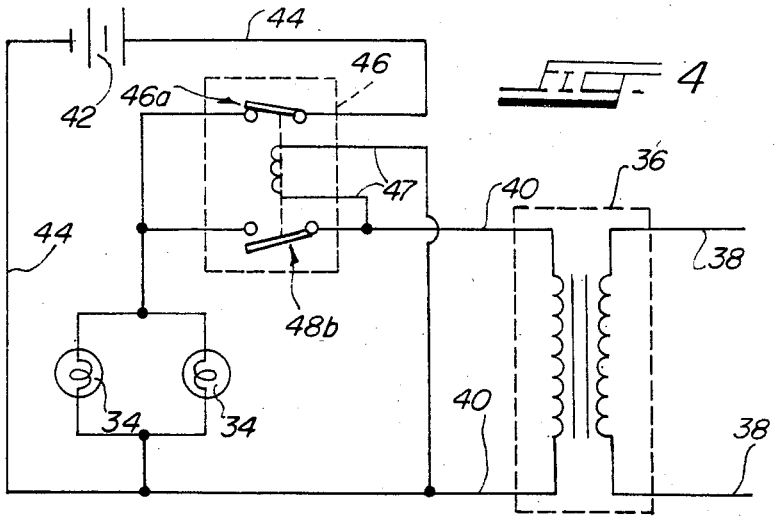
FIG. 4 is a schematic diagram of the electrical circuit of said preferred embodiment.

In the preferred embodiment, as shown in FIGS. 3 and 4, a step down transformer 36 is mounted in the box 10 contiguous to the platform 30, the lead wires 38 to the primary of the transformer being extended either through one side wall, the top wall or the back wall of the box 10 depending upon the location of convenient access to household electrical power.

The secondary of the transformer 36 is connected by lead wires 40 to the appropriate taps on the bulb mounting components 32 for the light bulbs 34, in the manner well known in the art, to supply the proper voltage to the bulbs for illumination of the same when the transformer is electrically connected to the household electrical line.

In addition to enhancing the desired level and uniformity of illumination of the unit, the provision of two light bulbs connected in parallel affords a margin of safety in that both bulbs would rarely burn out simultaneously, so that when a first bulb burns out the home owner is forewarned to replace the bulbs before the second bulb burns out.

In addition, to provide for continuity of operation in the event of a power failure, the preferred embodiment of the invention includes an alternate power source in the form of a battery 42 wired by leads 44 to the light bulb supporting components 32, and a relay 46 for sensing a power failure and automatically switching the unit from line power to battery power. Preferably, the energizing coil of the relay is connected to and powered from the secondary of the transformer 36 by lead wires 47 to sense either a line power failure or a transformer failure, thereby to provide for maximum safety in operation. To accommodate such operation, the relay 46 preferably includes two pairs of contacts **46*a* and 46*b*, respectively, the contacts 46*a* being connected in one of the leads 44 and being normally closed to connect the battery 42 in the light bulb circuit when line power is off, and the contacts 46*b* being connected in one of the leads 40 and being normally open to disconnect the transformer secondary from the battery and the bulbs when line power is off. When line power is on, the energizing coil of the relay is powered from the transformer secondary to close the contacts 46*b* and open the contacts 46*a***, whereby to connect the line power circuit to the bulbs and to disconnect the battery circuit. Thus, operation of the emergency light is assured whether line power is on or off, thereby to provide for the user's safety even in the event of power failures.

The relay 46 is appropriately mounted on the back wall 14 of the box by a bracket 48, and the battery 42, which may be either long wearing or rechargeable, is removably mounted on the back wall 14 by a releasable clip type battery mounting bracket 50.

The bottom wall 28 of the housing or box 10 is formed of a light emitting material, which may be either transparent or translucent, and the wall may be either permanently or removably attached to the bottom flanges 27 of the side walls of the box. The functions thus served by the bottom wall are to enclose the electrical components and to serve as a lens for directing light downwardly onto the exit door or other emergency object above which the unit is installed. In the preferred embodiment, the bottom wall is transparent in order to direct a relatively bright beam of light directly downward onto the emergency object.

The front face 12 of the housing 10 is also formed of light emitting material and carries a desired directive, e.g., "EXIT", whereby such directive will be clearly illuminated by the lights within the box. In the preferred embodiment, the front face comprises a light diffusing translucent panel in order to enhance the legibility of the directive thereon and to minimize the projection of bright or distracting light into the room in which the unit is installed. The front face is removably secured to the box, for example by a pair of screws 26, thereby to facilitate access to and servicing of the electrical components within the box without necessitating removal of the unit from the wall to which it is affixed.

In the preferred embodiment of the invention, as illustrated in the drawings, the letters in the directive word "EXIT" are three inches tall and ideally spaced to be clearly visible in practically all residential rooms of customary size, especially when the word is illuminated from behind by a pair of low voltage light bulbs. The directive word remains clearly visible even under such adverse conditions as the room being filled with smoke. To enhance visibility, the word may be either direct printed or reverse printed, and may be delineated by a contrasting ink, either transparent or opaque, all within the skill of the art.

While thus accommodating a very clear image of a directive word or symbol, the emergency light remains small, compact and structurally economical. Specifically, the preferred embodiment as above described may be entirely housed within a box 10 that is only $5\frac{7}{8}$ inches wide, $4\frac{1}{8}$ inches tall, $2\frac{7}{8}$ inches deep at its top, and $1\frac{3}{8}$ inches deep at its bottom. The invention thus provides an emergency light that it small, compact, low in initial cost and economical in operation, whereby to attain all of the objects and advantages of the invention in a facile and highly effective manner.

While a single preferred embodiment of the invention has been herein illustrated and described, it is to be appreciated that various changes, rearrangements and modifications may be made therein without departing from the scope of the invention as defined by the appended claims.

What is claimed is:

1. An emergency light for illuminating an emergency object such as an exit door, comprising a box to be mounted on a vertical supporting surface above the emergency object, said box having a vertical rear wall for attachment to such surface, a horizontal top wall, and a pair of trapezoidal shaped sidewalls having a major depth dimension at the top and a minor depth dimension at the bottom, said walls being unitary and formed of opaque material, said trapezoidal shaped sidewalls defining a downwardly and rearwardly inclined front face and a horizontal bottom face on the box, said sidewalls each having inturned flanges on the front and bottom edges thereof; front and bottom walls for said box formed of light emitting material and removably secured to said inturned flanges for closing the front and bottom faces of said box, said front and bottom walls being removable to facilitate access to the interior of said box; a pair of low voltage light bulbs mounted on said rear wall within the interior of said box with their axes substantially aligned and parallel with said rear wall and their light emitting bulbs spaced apart for illuminating the entirety of said front and bottom walls, and low voltage power source means mounted on said rear wall within the interior of said box for illuminating said bulbs, said bulbs being connected in parallel for simultaneous illumination whereby, upon failure of either one of said bulbs, the emergency light remains functional but a warning is conveyed to replace said bulbs; said light emitting front wall bearing an emergency directive; said light bulbs, upon illumination thereof, illuminating said front wall to illuminate the directive thereon and casting light forwardly and downwardly through said front wall and downwardly through said bottom wall to illuminate the emergency object and surrounding area to facilitate location of and access to the object.

2. An emergency light as set forth in claim 1, wherein said front wall is formed of light diffusing translucent material to facilitate reading of the directive thereon.

3. An emergency light as set forth in claim 1, wherein said bottom wall is formed of transparent material to direct a beam of light directly downwardly onto the emergency object.

4. An emergency light as set forth in claim 1, wherein said front wall is formed of light diffusing translucent material to facilitate reading of the directive thereon and to minimize projection of distracting light therethrough, and said bottom wall is formed of transparent material to direct a beam of relatively bright light directly downwardly onto the emergency object.

5. An emergency light as set forth in claim 1, wherein said low voltage means for illuminating said light includes a step down transformer mounted in said box and having its secondary connected to said light bulbs and its primary wired for connection to line voltage.

6. An emergency light as set forth in claim 1, wherein said low voltage means for illuminating said light includes a battery removably mounted in said box and connected to said light bulbs.

7. An emergency light as set forth in claim 1, wherein said means for illuminating said light includes a primary power source connected to said light bulbs for normally illuminating said light, a battery mounted in said box and including circuit means for connection to said light bulbs, and a relay connected with said primary power source for energization thereby and including normally closed contacts in said battery circuit, said relay upon energization opening said normally closed contacts to disconnect the battery circuit means from the light bulbs, said relay upon sensing a failure of said primary power source causing said contacts to close thereby to cause the light to be energized by said battery upon failure of the primary power source.

* * * * *